US010092101B2

(12) United States Patent
Cattaneo

(10) Patent No.: US 10,092,101 B2
(45) Date of Patent: Oct. 9, 2018

(54) ADJUSTABLE WALL CUPBOARD HOLDER

(75) Inventor: Carlo Cattaneo, Figino Serenza—Como (IT)

(73) Assignee: LEONARDO S.R.L., Figino Serenza Como (IT)

( * ) Notice: Subject to any disclaimer, the term of this patent is extended or adjusted under 35 U.S.C. 154(b) by 414 days.

(21) Appl. No.: 12/736,936

(22) PCT Filed: Jul. 24, 2009

(86) PCT No.: PCT/EP2009/005628
§ 371 (c)(1),
(2), (4) Date: Nov. 22, 2010

(87) PCT Pub. No.: WO2010/012504
PCT Pub. Date: Feb. 4, 2010

(65) Prior Publication Data

US 2011/0062297 A1 Mar. 17, 2011

(30) Foreign Application Priority Data

Jul. 29, 2008 (IT) ..... MI08A1394

(51) Int. Cl.
*A47B 96/00* (2006.01)
*A47B 95/00* (2006.01)

(52) U.S. Cl.
CPC ..... *A47B 95/008* (2013.01)

(58) Field of Classification Search
CPC ..... A47B 95/008; A47B 2095/006; A47B 2077/025; A47B 96/067; A47B 96/07; A47B 7/00
USPC ..... 248/220.21, 221.11, 222.51, 223.31, 248/225.21, 222.14; 312/245, 257.1, 263, 312/111, 247, 248, 246; 411/22, 32, 411/54.1, 54, 55, 80.1, 45, 46, 47, 48
See application file for complete search history.

(56) References Cited

U.S. PATENT DOCUMENTS 3,695,655 A * 10/1972 Wippermann ..... F16B 12/2054 403/260
3,946,979 A * 3/1976 Ehlebracht ..... F16B 2/18 248/274.1
4,871,289 A * 10/1989 Choiniere ..... E04D 3/3603 411/41
4,936,534 A * 6/1990 Cattaneo ..... A47B 77/02 24/593.1
5,351,924 A * 10/1994 Schroder ..... A47B 95/008 248/227.1

(Continued)

FOREIGN PATENT DOCUMENTS

DE 295 07 071 U1 8/1995
DE 201 03 728 U1 5/2001

(Continued)

OTHER PUBLICATIONS

PCT Search Report dated Nov. 16, 2009.

*Primary Examiner* — Christopher Garft
(74) *Attorney, Agent, or Firm* — Hedman & Costigan, P.C.; James V. Costigan; Kathleen A. Costigan

(57) ABSTRACT

An adjustable wall cupboard holder group (10) for anchoring a cupboard (11) to the wall comprises at least one element resistant to shear forces (20) which collaborates with fixing means (19) for a stable positioning of said wall cupboard holder group (10) on the shoulder (12) of the cupboard.

9 Claims, 7 Drawing Sheets

(56) References Cited

U.S. PATENT DOCUMENTS

| | | | | | |
|---|---|---|---|---|---|
| 5,351,929 | A * | 10/1994 | Vallance | A47B 95/008 | 248/222.51 |
| 5,607,271 | A * | 3/1997 | Salice | E05D 5/08 | 411/273 |
| 5,611,637 | A * | 3/1997 | Brustle | A47B 88/00 | 312/111 |
| 5,966,779 | A * | 10/1999 | Salice | E05D 5/0276 | 16/382 |
| 6,234,596 | B1 * | 5/2001 | Egger | A47B 88/95 | 312/263 |
| 6,406,235 | B1 * | 6/2002 | Bantle | F16B 12/14 | 411/41 |
| 7,490,385 | B2 * | 2/2009 | Migli | E05D 5/0276 | 16/237 |
| 2004/0237257 | A1 * | 12/2004 | Pohl | F25D 23/028 | 16/221 |
| 2006/0162621 | A1 * | 7/2006 | Fisher | A47B 37/04 | 108/44 |
| 2012/0018602 | A1 * | 1/2012 | Cattaneo | A47B 95/008 | 248/222.11 |

FOREIGN PATENT DOCUMENTS

| | | |
|---|---|---|
| EP | 0 033 179 A1 | 8/1981 |
| EP | 0 632 979 A1 | 1/1995 |
| EP | 1 228 720 A1 | 8/2002 |

* cited by examiner

Fig. 5
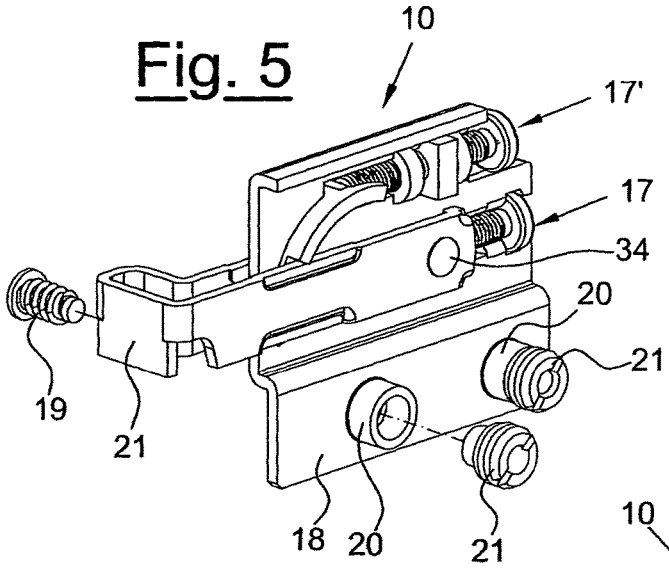
Fig. 5b
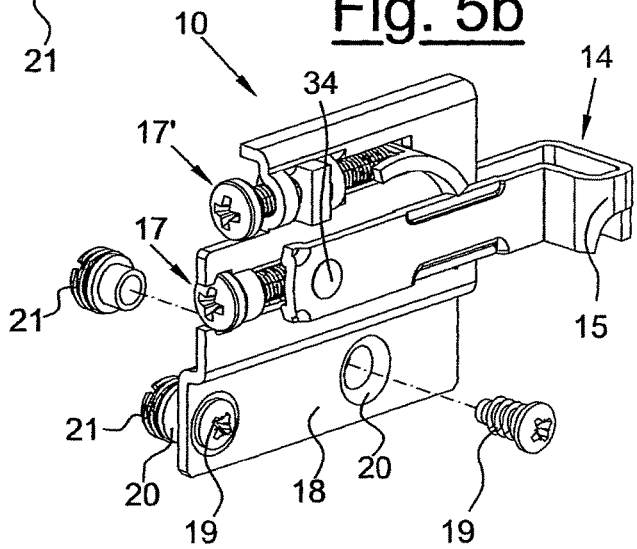
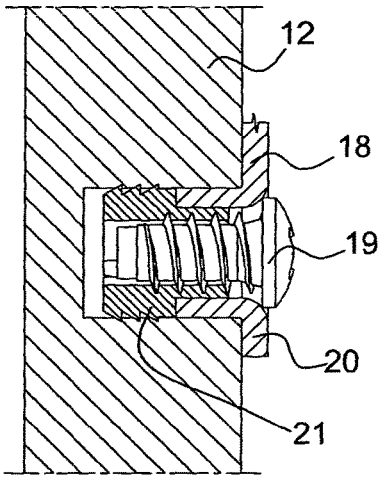
Fig. 5c

Fig. 6
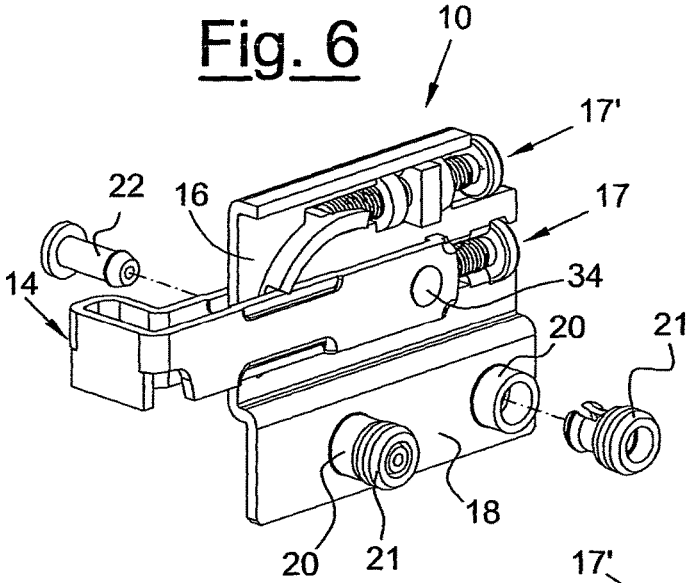
Fig. 6b
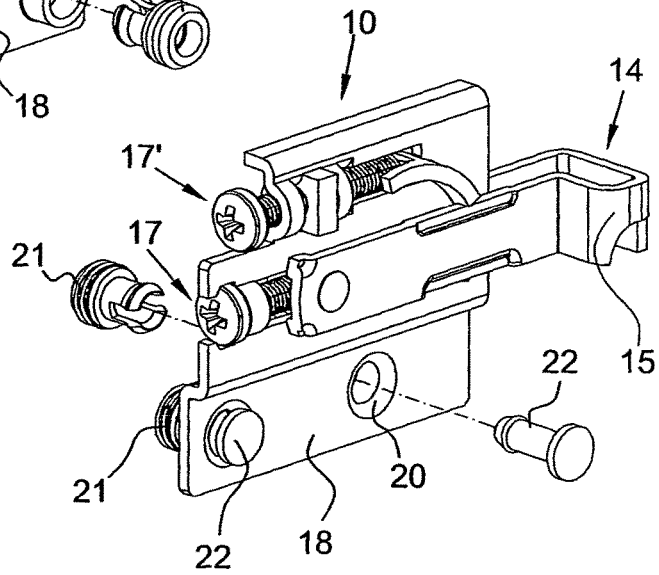
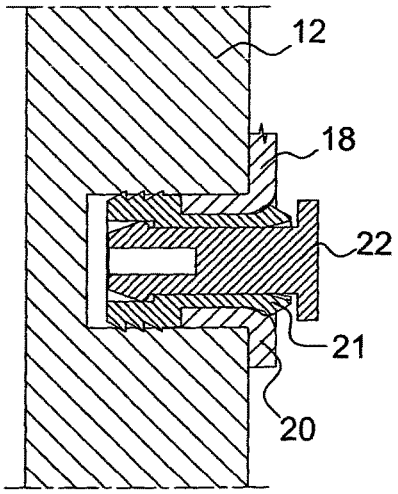
Fig. 6c

ADJUSTABLE WALL CUPBOARD HOLDER

The present invention relates to a visible wall cupboard holder group, adjustable for anchoring a cupboard to the wall, with perfected fixing means to the shoulder of the same cupboard.

In particular, the wall cupboard holder in question is defined as being visible as it is destined for being assembled inside a wall cupboard.

Wall cupboard holders in which a hook is situated at the free end of an arm which extends externally from a box-shaped body made of plastic material, are well known to experts in the field.

Said box-shaped body contains a mechanism for regulating the positions in depth and height of the hook, which is to be hooked to a wall support, a shaped metallic section, peg or other similar item.

The wall cupboard holder thus structured is fixed to the shoulder of the cupboard by means of self-threading screws, or pressure-yielding plugs made of a plastic material, with a saw-toothed profile, in correspondence with the upper edges of the cupboard, defined by the shoulder, cover or top.

The screws are pass-through, i.e. they pass through the box-shaped body and are screwed directly into the shoulder of the cupboard, whereas the plugs extend integrally and laterally from the box-shaped body made of plastic material and are pressure-inserted into a corresponding seat of the shoulder.

A wall cupboard holder of the type briefly described above is described and illustrated, for example, in patents EP 0033179 B1 and EP 0632979 A1.

There are also other types of wall cupboard holders which substantially differ in the supports with which they are fixed to the cupboards and also in the means with which it is possible to regulate the positions in depth and height (inclination) of the rear hook.

These wall cupboard holders, described for example in EP 1228720 B1, at present generally consist of a plate element equipped with a side flange which, in the assembly phase, is normally fixed by means of screws or expansion pegs in holes situated on the shoulder of the wall cupboard.

As mentioned above, the above known wall cupboard holders comprise a moveable hook element for fixing the cupboard to the wall which, as described in EP 1228720 B1, is driven by screw-female screw mechanisms, possibly equipped with angular countershafts, capable of allowing the regulation of the rear position of the supporting hook (see also EP 0033179 B1 and EP 0632979 A1).

Although these known wall cupboard holders are currently functional and satisfy the safety regulations in force in the field of hanging furniture items, in view of the present tendency to reduce the thicknesses of the panels forming wall cupboards and increasing diffusion of these pieces of furniture, which are also frequently overloaded, it can unfortunately happen that this cupboard/cupboard holder coupling is not always effective, long-lasting and above all safe.

As the stability of the wall cupboard depends on this constraint, unfortunately the wall cupboard frequently falls dangerously and/or breaks as a result of the shear forces acting in the wall cupboard holder coupling which are generated when the cupboard is loaded.

The above drawbacks mainly occur in the wall cupboard holders of EP 0033179 B1 and EP 0632979 A1, with a box-shaped body made of plastic material.

A general objective of the present invention is to solve the above drawbacks of the known art in an extremely simple, economical and particularly functional manner.

A further objective is to provide a visible wall cupboard holder group for anchoring a wall cupboard to the wall, which ensures an easy and firm assembly on any type of wall cupboard.

Another objective is to provide a visible wall cupboard holder group for anchoring a wall cupboard to the wall, which is capable of resisting high shear forces which can be generated in the cupboard/wall cupboard holder coupling once the cupboard has been loaded.

In view of the above objectives, according to the present invention, a visible wall cupboard holder group has been conceived for anchoring a cupboard to the wall, having the characteristics specified in the main claim and enclosed subclaims.

The structural and functional characteristics of the of the present invention, and its advantages with respect to the known art, will appear more evident from the following description, referring to the enclosed schematic drawings, which illustrate examples of visible wall cupboard holder groups for anchoring a wall cupboard to the wall produced according to the innovative principles of the same invention.

Figure 2:
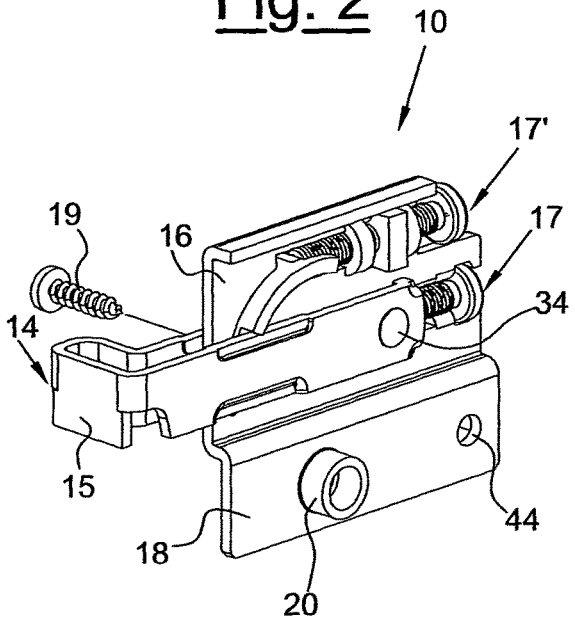
FIG. 2 is a perspective view of the wall cupboard holder group of FIG. 1 assembled.
Figure 2B:
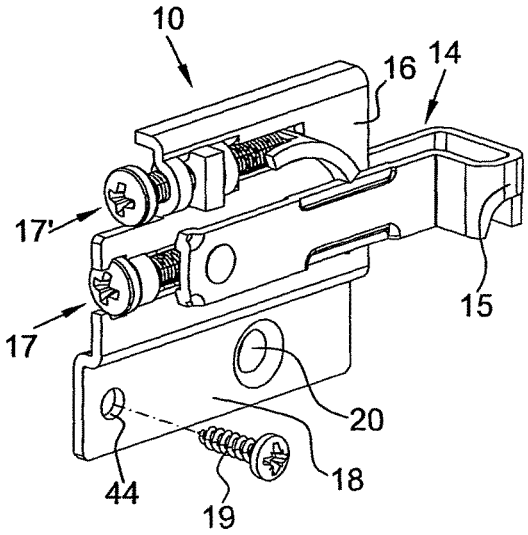
Figure 2C:
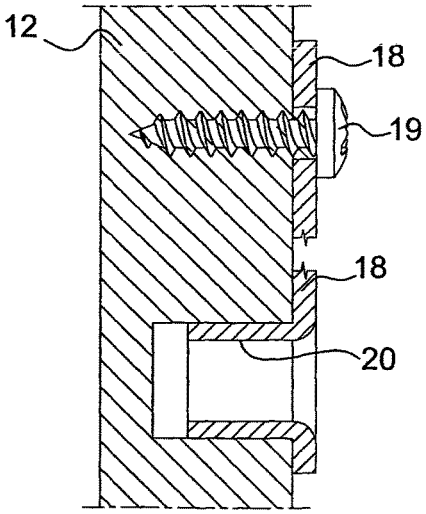
Figure 3:
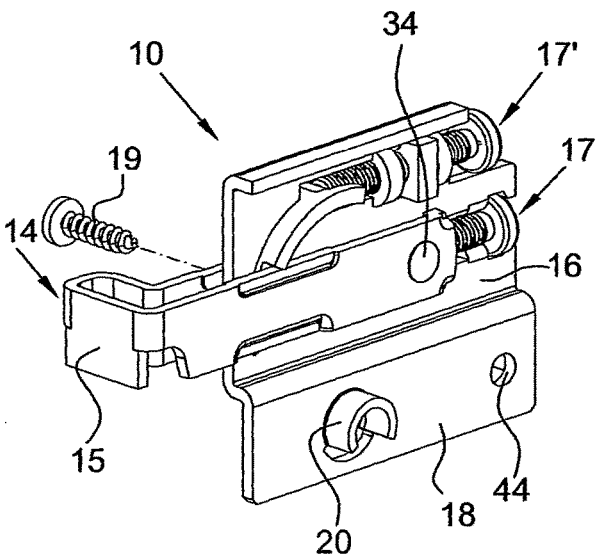
Figure 3B:
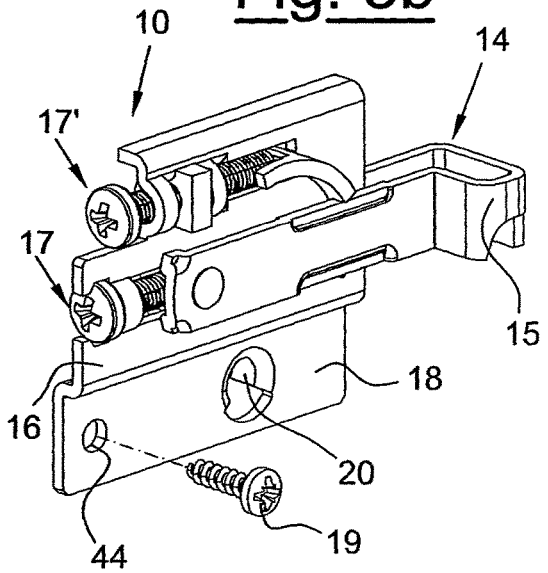
Figure 3C:
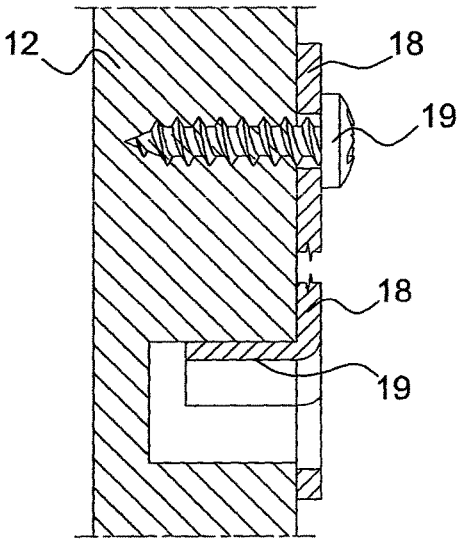
Figure 4:
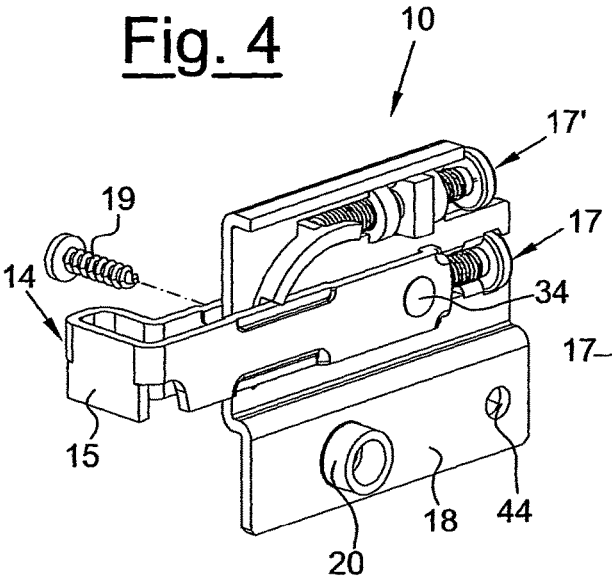
Figure 4B:
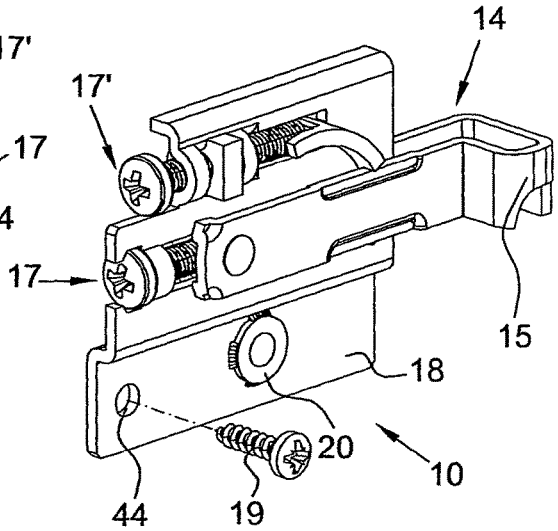
Figure 4C:
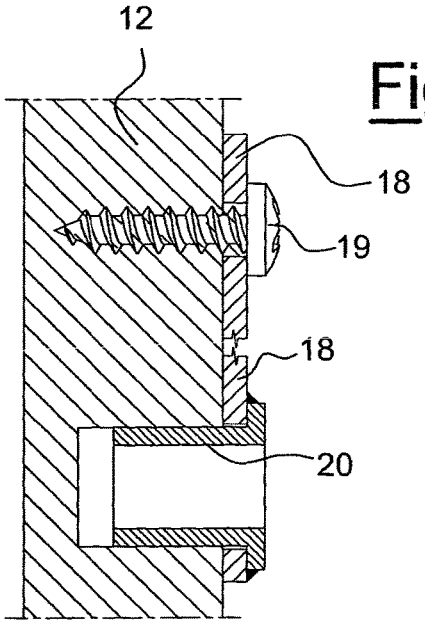
Figure 7:
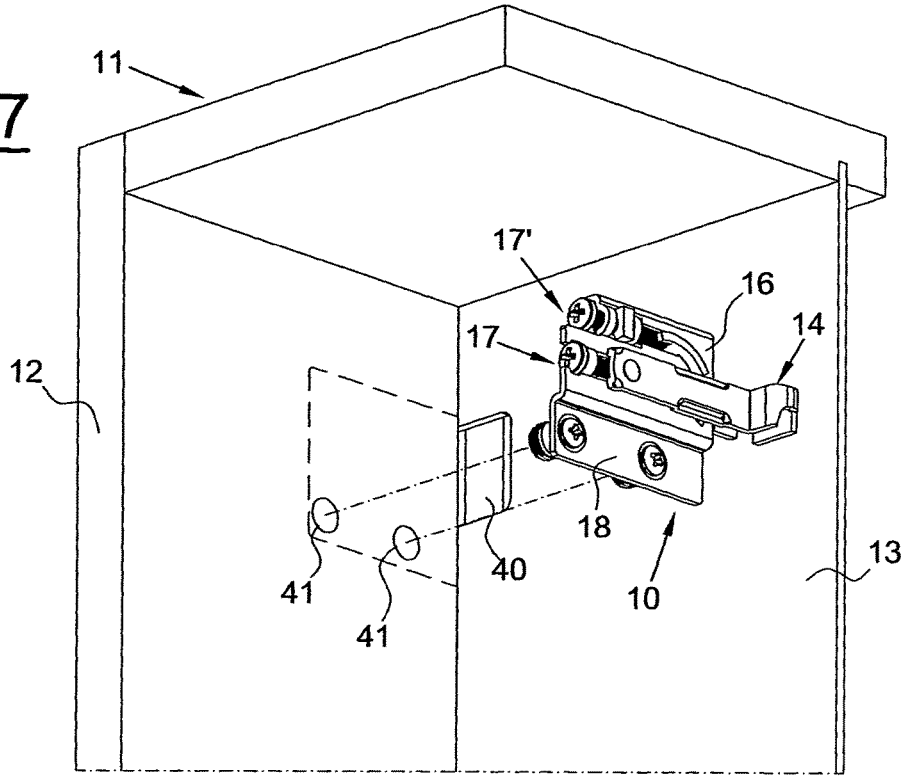
Figure 7B:
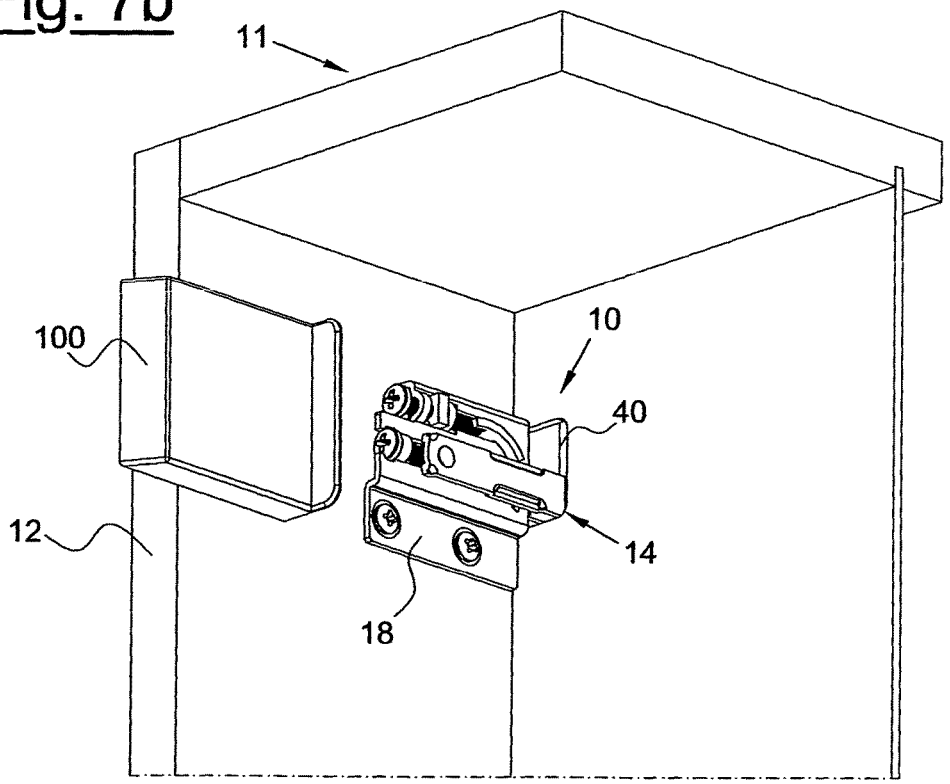

FIG. 2*b* is another perspective view of the wall cupboard holder group of FIG. 2;

FIG. 2*c* is an enlarged view of a detail of the wall cupboard holder group of FIGS. 2-2*b* assembled on the relative wall cupboard;

FIG. 3 is a perspective view of another wall cupboard holder group according to the present invention;

FIG. 3*b* is another perspective view of the wall cupboard holder group of FIG. 3;

FIG. 3*c* is an enlarged view of a detail of the wall cupboard holder group of FIGS. 3-3*b* assembled on the relative wall cupboard;

FIG. 4 is a perspective view of another wall cupboard holder group according to the present invention;

FIG. 4*b* is another perspective view of the wall cupboard holder group of FIG. 4;

FIG. 4*c* is an enlarged view of a detail of the wall cupboard holder group of FIGS. 4-4*b* assembled on the relative wall cupboard;

FIG. 5 is a perspective view of another wall cupboard holder group according to the present invention;

FIG. 5*b* is another perspective view of the wall cupboard holder group of FIG. 3;

FIG. 5*c* is an enlarged view of a detail of the wall cupboard holder group of FIGS. 5-5*b* assembled on the relative wall cupboard;

FIG. 6 is a perspective view of another wall cupboard holder group according to the present invention;

FIG. 6*b* is another perspective view of the wall cupboard holder group of FIG. 3;

FIG. 6*c* is an enlarged view of a detail of the wall cupboard holder group of FIGS. 6-6*b* assembled on the relative wall cupboard;

FIG. 7 is a perspective view of the wall cupboard holder group according to the present invention in the assembly phase on the relative wall cupboard;

FIG. 7*b* is a perspective view of the wall cupboard holder group of FIG. 5 assembled on the relative wall cupboard.

With reference to the drawings, a visible and adjustable wall cupboard holder group for anchoring a cupboard to the wall in question is indicated as a whole with 10.

Figure 1:
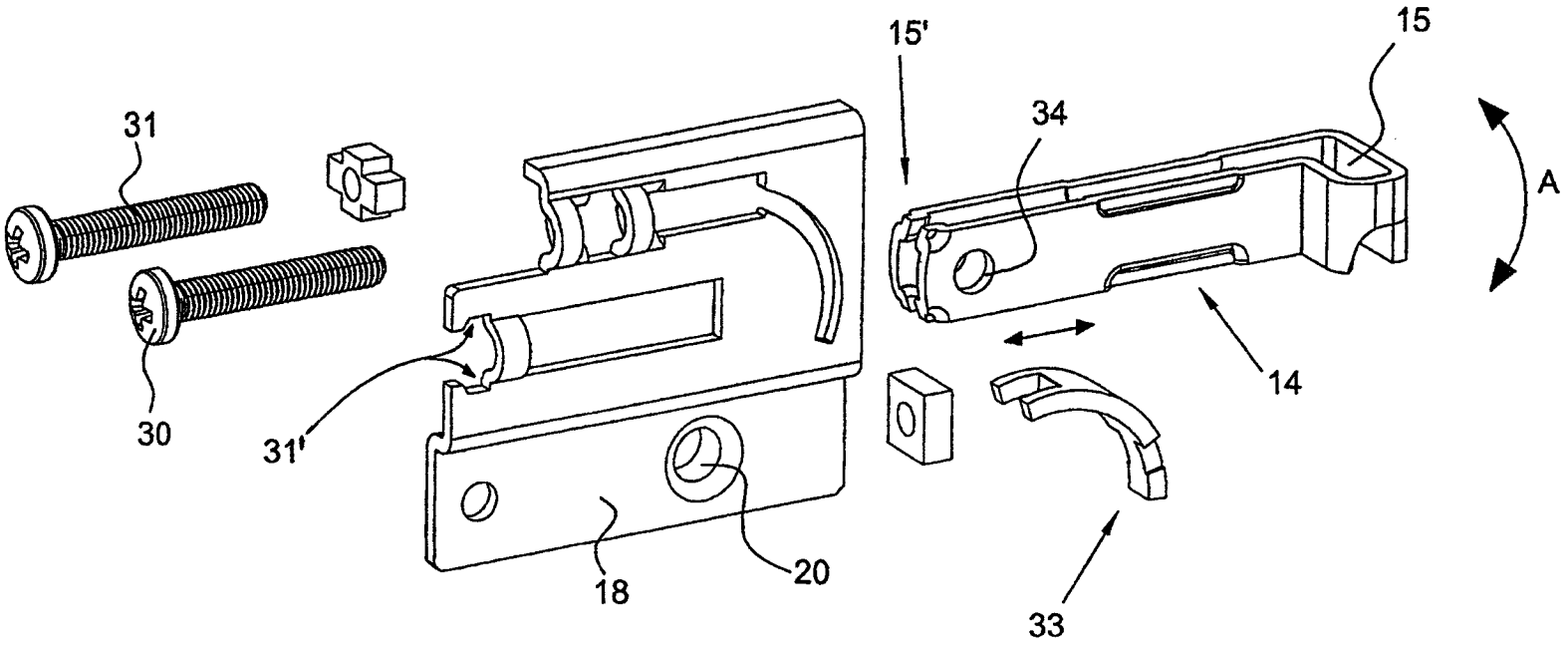
FIG. 1 is an exploded view of a visible wall cupboard holder group for anchoring a wall cupboard to the wall according to the present invention.

Said wall cupboard holder group 10, visible and exploded in FIG. 1 is suitable for effecting the anchoring of a wall cupboard 11 to a wall and during use is coupled on one side to an internal side wall 12 of the above wall cupboard 11 (shoulder) and on another, which at least partially protrudes externally from a hole 40 situated on a rear cover 13 of the same wall cupboard 11 (cover), to a supporting element fixed to the wall (generally a metallic section).

This assembly phase with the relative couplings of the wall cupboard holder 10 in the rear hole 40 and in the side holes 41 of the wall cupboard 11 is shown in FIGS. 7 and 8, whereas FIGS. 7*b* and 8*b* illustrate the same wall cupboard holders 10 after assembly with the relative rear portions 15 protruding beyond the rear wall 13 of the wall cupboard 11.

As can be seen, according to an embodiment of the invention, there can also be a covering top 100, generally made of plastic, of the wall cupboard holder 10.

In particular as clearly shown in FIG. 1, the wall cupboard holder 10 according to the invention comprises a hooking element 14 to a supporting element fixed to the wall, said hook 14 is coupled at a first end 15' to a central portion 16 of a plate element whereas at a second end, which freely protrudes behind the central portion 16, there is a hook-shaped fixing portion 15 to the above support. In order to allow regulations, the connection of the hooking element 14 to the central portion 16 is of the adjustable type in depth F and inclination A.

For this purpose, regulation means 17, 17' of the depth F and inclination A of the hooking element 14 are envisaged, said means 17, 17' are associated with and accessible in the front to the central portion 16.

According to the invention, the wall cupboard holder as described above also comprises a side flange 18 which extends from the central portion 16, in which said side flange 18 comprises fixing means 19 of the wall cupboard holder group 10 to the internal side wall 12 of the wall cupboard 11, in addition to the presence of at least one element resistant to the shear forces 20, which are generated when the wall cupboard holder 10 is assembled and when the wall cupboard is loaded.

Said at least one element resistant to shear forces 20 protrudes from the side flange 18 on the side facing the internal side wall 12 of the wall cupboard 11, and collaborates with the previous fixing means 19 for a stable positioning of the wall cupboard holder 10 on an internal wall 12 of the wall cupboard 11.

As can be seen in FIG. 1, the regulation means 17, 17' of the depth F and inclination A of the hooking element 14, which, as already mentioned, are associated with and accessible in the front to the central portion 16, comprise two screw-female screw mechanisms.

In these mechanisms, there is a first regulation screw 30 equipped with a head which is firmly housed/entrapped in a counter-form 31' situated in the first portion 16 and a threaded development which is longitudinally associated in an internal threaded seat of the hooking element 14 in correspondence with the end 15' opposite the hook 15.

Said first regulation screw 30 allows the longitudinal movement (depth) of the hooking element 14 to be regulated.

According to the invention, a second regulation screw 31 is also envisaged, which is associated with the first central portion 16 in a parallel and upper position with respect to the first regulation screw 30.

Said second regulation screw 31 acts on a movable circular lunette 33 situated at the opposite side with respect to the head of the second regulation screw 31 and can be moved, specifically due to the effect of the second regulation screw 31, to enforce a rotation of the hooking element 14 around a riveted pin 34.

According to an embodiment shown in FIGS. 2-2*c*, the elements resistant to shear forces 20 comprise at least one plug element 20 protruding from the side flange 18, which is coupled, not necessarily forcedly, with a hole 41 situated in the internal side wall 12 of the wall cupboard 11 (shoulder).

As shown in FIG. 2*c*, said plugs 20 collaborate with the previous fixing means 19, for example screws, for a stable positioning of the wall cupboard holder 10 on an internal side wall 12 of the wall cupboard 11, completely preventing the misalignment of the wall cupboard holder 10 with respect to the relative wall cupboard 11.

In the above embodiment, the plug elements 20 can be positioned directly on the side flange 18 during the production of the wall cupboard holder 10, but alternatively they can also be produced separately and subsequently welded onto the side flange 18, as shown in the embodiment of FIGS. 4-4*c*.

The plug elements so far described are preferably hollow cylindrical plugs with a circular section but, alternatively, and in relation to the type of cupboard to be coupled with the wall cupboard holder 10 and an estimation of the load burdens, they can be hollow cylindrical plugs having a non-circular but circumferential arc section as shown in the embodiments of FIGS. 3-3*c*.

As already specified, the fixing means 19 can comprise at least one fixing screw 19 of the flange 18 to the internal side wall 12 of the wall cupboard 11 in which said at least one fixing screw 19 can be coupled with the relative side flange 18 in a different position with respect to the at least one plug element 20 through relative holes 44.

Alternatively, the above screws 19 can be coupled with the side flange 18 inside the previous plug elements 20.

According to another embodiment, the wall cupboard holder group 10 can comprise, as fixing means 19, at least one expansion peg 21 equipped with gripping teeth and which can be activated by screws 19, which (21), like the screws 19 of the previous examples, fixes the side flange 18 to the internal side wall 12 of the wall cupboard 11.

Said pegs 21 can be coupled with the side flange 18 either in a different position with respect to the at least one plug element 20, or, as shown in FIGS. 5-5*c*, coaxially to the at leapt one plug element 20.

Finally, according to a last embodiment, the fixing means comprise at least one expansion peg 21 activated by means of cursors 22 with shaped heads which 21, like the previous pegs, fix the side flange 18 to the internal side wall 12 of the wall cupboard 11.

These pegs 21 can also be coupled with the side flange 18 either in a different position or coaxially to the at least one plug element 20, as shown in FIGS. 6-6*c*.

From the above description, and with reference to the figures, it is evident how a visible wall cupboard holder group for anchoring a wall cupboard to the wall according to the invention is particularly useful and advantageous. The objective indicated in the preamble of the invention has therefore been achieved.

The visible and adjustable wall cupboard holder 10 for the assembly of a wall cupboard to a wall according to the present invention, in fact, ensures an easy and firm assembly on any type of wall cupboard preventing any possible misalignment of the wall cupboard holder 10 itself with respect to the relative cupboard also when the latter is loaded.

This firm positioning can be obtained thanks to the presence of the elements resistant to shear forces 20 protruding from the side flange 18 towards the internal side wall 12 of the wall cupboard 11, wherein said elements resistant to shear forces 20, such as cylindrical plugs, collaborate with the fixing means 19, such as screws or expansion pegs possibly equipped with gripping teeth, to ensure a stable positioning of the wall cupboard holder group 10 on the internal wall 12 of the wall cupboard 11.

The forms of the visible wall cupboard holder group 10 for the fixing of a wall cupboard to a wall, of the invention, as also the materials, can obviously differ from those shown for purely illustrative and non-limiting purposes in the drawings.

The protection scope of the invention is therefore delimited by the enclosed claims.

The invention claimed is:

1. An adjustable wall cupboard holder group (10) for anchoring a wall cupboard (11) to a wall adapted to hold a wall cupboard and suitable for being coupled on one side with an internal side wall (12) of said wall cupboard (11) and on another side, at least partially protruding externally from a rear wall or cover (13) of said wall cupboard (11), with a support fixed to the wall adapted to hold a wall cupboard, said wall cupboard holder group (10) comprising a hooking element (14) to a supporting organ fixed to the wall adapted to hold a wall cupboard, coupled at a first end with a central portion (16) of said wall cupboard holder group (10) that has a front portion, said hooking element (14) being adjustable in depth and inclination and equipped with a second free end protruding from behind said central portion (16), said second free end being a hook-shaped end (15) for fixing to said support fixed to the wall adapted to hold a wall cupboard, said wall cupboard holder group (10) including regulation means (17, 17') for regulating the depth and inclination of said hooking element (14), said regulation means (17, 17') for adjusting the depth and inclination of said hooking element (14) being accessible in the front of said central portion (16), and said regulation means comprising two screw-female screw mechanisms in which the head of a first regulation screw (30) is firmly housed in a counter-form (31') situated in said central portion (16), said first regulation screw (30) being longitudinally associated in an internal threaded seat of said hooking element (14) at an end (15') opposite to said hook (15) for the longitudinal movement of said hooking element (14), a second regulation screw (31) which is associated with said central portion (16) in a parallel and upper position with respect to said first regulation screw (30), said second regulation screw (31) acting on a movable circular lunette (33) enforcing a rotation of said hooking element (14) around a riveted pin (34) where said circular lunette (33) has an indentation that engages an end of said second regulation screw (31) and a top surface that is smooth said wall cupboard holder group (10) comprising a side flange (18) which extends from said central portion (16) and is associated with a fixing means (19) of said wall cupboard holder group (10) on said one internal side wall (12) of said wall cupboard (11), said wall cupboard holder group (10) also comprising at least one cylindrical plug element (20) resistant to shear forces generated when the wall cupboard is loaded, where said plug element (20), resistant to shear forces generated when the wall cupboard is loaded protrudes from said side flange (18) towards said internal side wall (12) of said wall cupboard (11) and said at least one cylindrical plug element (20) resistant to shear forces generated when the wall cupboard is loaded is integral with said side flange (18) or welded to said side flange (18), said cylindrical plug (20) being adapted to fit into said internal side wall (12) of said wall cupboard (11), said at least one cylindrical plug element (20) resistant to shear forces generated when the wall cupboard is loaded collaborating with said fixing means (19) for a stable positioning of said wall cupboard holder group (10) on said internal side wall (12) of said wall cupboard (11).

2. The wall cupboard holder group (10) according to claim 1, characterized in that said side flange (18) extends from below said central portion (16).

3. The wall cupboard holder group (10) according to claim 1 characterized in that said at least one cylindrical plug element, resistant to shear forces generated when the wall cupboard is loaded, is welded onto said side flange (18).

4. The wall cupboard holder group (10) according to claim 1, characterized in that said at least one cylindrical plug element (20) resistant to shear forces generated when the wall cupboard is loaded is a hollow cylindrical plug with a circumferential arc section.

5. The wall cupboard holder group (10) according to claim 1, characterized in that said at least one cylindrical plug element (20) resistant to shear forces generated when the wall cupboard is loaded is a hollow cylindrical plug with a circular section.

6. The wall cupboard holder group (10) according to claim 1, characterized in that said fixing means (19) comprises at least one fixing screw coupled with said side flange (18) to said internal side wall (12) of said wall cupboard (11), said at least one screw being coupled with said side flange (18) in different positions with respect to said at least one cylindrical plug element (20) resistant to shear forces generated when the wall cupboard is loaded.

7. The wall cupboard holder group (10) according to claim 1, characterized in that said fixing means (19) comprise at least one expansion peg (21) affixed by means of a fixing screw (19) for fixing said side flange (18) to said internal side wall (12) of said wall cupboard (11), said at least one peg (21) being coupled with said side flange (18) in different positions with respect to at least one cylindrical plug element (20) wherein said peg (21) has gripping teeth.

8. The wall cupboard holder group (10) according to claim 1, characterized in that said fixing means (19) comprise at least one expansion peg (21) affixed by means of a fixing screw (19) coupled with said side flange (18) to said internal side wall (12) of said wall cupboard (11), said at least one peg (21) being coupled with said side flanges (18) coaxially to said at least one cylindrical plug element (20) resistant to shear forces generated when the wall cupboard is loaded and said screw being inside said at least one plug element (20).

9. The wall cupboard holder group (10) according to claim 1, characterized in that said fixing means comprise at least one expansion peg (21) expandable by means of a cursor (22) with a shaped fixing head, said at least one expansion peg (21) being coupled with said side flange (18) coaxially to said at least one cylindrical plug element (20) resistant to shear forces generated when the wall cupboard is loaded with said cursor (22) being inside said at least one expansion peg (21).

* * * * *